United States Patent [19]

Keller et al.

[11] Patent Number: 4,900,244

[45] Date of Patent: Feb. 13, 1990

[54] GAS FLARING METHOD AND APPARATUS

[75] Inventors: Michael R. Keller; Roger K. Noble, both of Tulsa; Dale W. Pressnall, Sapulpa, all of Okla.

[73] Assignee: John Zink Company, Tulsa, Okla.

[21] Appl. No.: 645,343

[22] Filed: Aug. 29, 1984

[51] Int. Cl.[4] ..... F23D 14/00

[52] U.S. Cl. ..... 431/5; 431/202; 431/328; 431/346

[58] Field of Search ..... 431/5, 8, 202, 328, 431/346; 239/555, 554, 552; 11/11

[56] References Cited

U.S. PATENT DOCUMENTS

| | | | |
|---|---|---|---|
| 1,227,277 | 5/1917 | Land . | |
| 1,420,405 | 6/1922 | Beler . | |
| 1,677,156 | 7/1928 | Vaughn . | |
| 1,735,261 | 11/1929 | Calhoun . | |
| 2,009,271 | 7/1935 | Moecker, Jr. . | |
| 2,348,011 | 5/1944 | Koppel | 239/552 |
| 2,369,235 | 2/1945 | Jaros . | |
| 2,572,445 | 10/1951 | Cannon, Jr. et al. . | |
| 2,618,540 | 11/1952 | Teti . | |
| 2,627,910 | 2/1953 | Abrams . | |
| 2,879,862 | 3/1959 | Burden | 431/5 |
| 3,013,602 | 12/1961 | Heimerl . | |
| 3,173,411 | 3/1965 | Corbin . | |
| 3,501,255 | 3/1970 | Greene | 431/202 |
| 3,703,349 | 11/1972 | Straitz . | |
| 3,807,940 | 4/1974 | Juricek . | |
| 3,833,335 | 9/1974 | Lazarre et al. . | |
| 3,933,420 | 1/1976 | Zink et al. | 431/202 |
| 4,137,036 | 1/1979 | Straitz . | |
| 4,442,901 | 4/1984 | Zison | 166/369 |
| 4,479,546 | 10/1984 | Bresie et al. | 166/267 |

*Primary Examiner*—Carroll B. Dority

*Attorney, Agent, or Firm*—Laney, Dougherty, Hessin & Beavers

[57] ABSTRACT

A method and apparatus for flaring a gas stream such as the gas mixtures formed in landfills while retarding the backward propagation of flame thereto are provided. The method comprises conducting the gas stream to a burner structure having a plurality of flow passages therein configured such that the gas stream can flow through the passages, but the backward propagation of flame therethrough is retarded; flowing the gas stream through the flow passages of the burner whereby the gas stream is jetted therefrom and initially mixed with air; igniting the gas stream; and mixing the ignited gas stream with additional air by confining the jetted and ignited gas mixture within a stack configured to allow the admission of air around the burner structure and to discharge products of combustion into the atmosphere.

7 Claims, 3 Drawing Sheets

GAS FLARING METHOD AND APPARATUS

BACKGROUND OF THE INVENTION

1. Field Of The Invention

The present invention relates generally to gas flaring methods and apparatus, and more particularly, but not by way of limitation, to a method and apparatus for flaring gas mixtures such as the gas mixtures emitted from landfills while retarding the backward propagation of flame in the gas mixtures.

2. Description Of The Prior Art

A great variety of waste and vent gas flaring methods and apparatus have been developed and used heretofore. Such methods and apparatus generally involve conducting the waste or vent gases to one or more burners which are elevated or which are positioned within the lower portion of a vertical stack. Air is mixed with the gases either just before the gases enter the burner or after the gases are emitted from the burner and the gases are combusted. The products of combustion are discharged into the atmosphere.

In systems where air is mixed with the gases just prior to entering the burners whereby an air-gas mixture flows through the burners, the burners have been equipped with means for retarding flashbacks, e.g., structure through which the air-gas mixture flows which prevents or retards backward flame propagation. Examples of such burners are described in U.S. Pat. Nos. 1,420,405 dated June 20, 1922; 2,627,910 issued Feb. 10, 1953; and 3,807,940 issued Apr. 30, 1974.

In flaring combustible gas mixtures which at their source contain flammable gases and combustion supporting gases such as oxygen or air, it is mandatory that the backward propagation of flame through the advancing mixture toward the source of the mixture be retarded since if such propagation takes place, fire and/or explosion can result. This problem is particularly severe in the flaring of gas mixtures formed in landfills since the flaring must take place at varying flow rates and flowing pressures.

The degradation of buried refuse and wastes in landfill areas often produces gas mixtures which collect within the landfill. The presence of such gas mixtures in the landfill presents a hazardous condition in that the gas mixtures can leak to the surface whereby they produce a nuisance such as by causing an odor problem, and they may be ignited. In order to eliminate the hazards presented by the formation of gas mixtures in landfills, such mixtures have been withdrawn therefrom and flared. However, because in the act of removing gas mixtures from landfills air is often introduced and combustible mixtures formed, problems have been encountered as a result of reverse flame propagation.

By the present invention, a method and apparatus for efficiently flaring gas streams including combustible gas mixtures which retard reverse propagation of flame are provided.

SUMMARY OF THE INVENTION

A method of flaring a gas stream while retarding the reverse propagation of flame therethrough is provided. The gas stream is conducted to a burner structure having a plurality of flow passages therein configured such that the gas stream can flow through the passages but the backward propagation of flame therethrough is retarded. The gas stream is flowed through the flow passages of the burner structure whereby it is jetted outwardly therefrom, initially mixed with air and ignited. The ignited gas stream is confined within a stack configured to allow the admission of air therein whereby additional air is mixed with the gas stream and to discharge combustion products into the atmosphere. Apparatus for carrying out the method is also provided.

It is, therefore, a general object of the present invention to provide a gas flaring method and apparatus.

A further object of the present invention is the provision of a method and apparatus for efficiently flaring combustible gas mixtures at low pressures and varying flow rates while retarding the backward propagation of flame through the gas mixture towards the source thereof.

Another object of the present invention is the provision of apparatus for flaring a combustible gas mixture while retarding the backward propagation of flame therethrough which is efficient and economical to install and operate.

Other and further objects, features and advantages of the present invention will be readily apparent to those skilled in the art upon a reading of the description or preferred embodiments which follows when taken in conjunction with the accompanying drawings.

DESCRIPTION OF PREFERRED EMBODIMENTS

Figure 1:
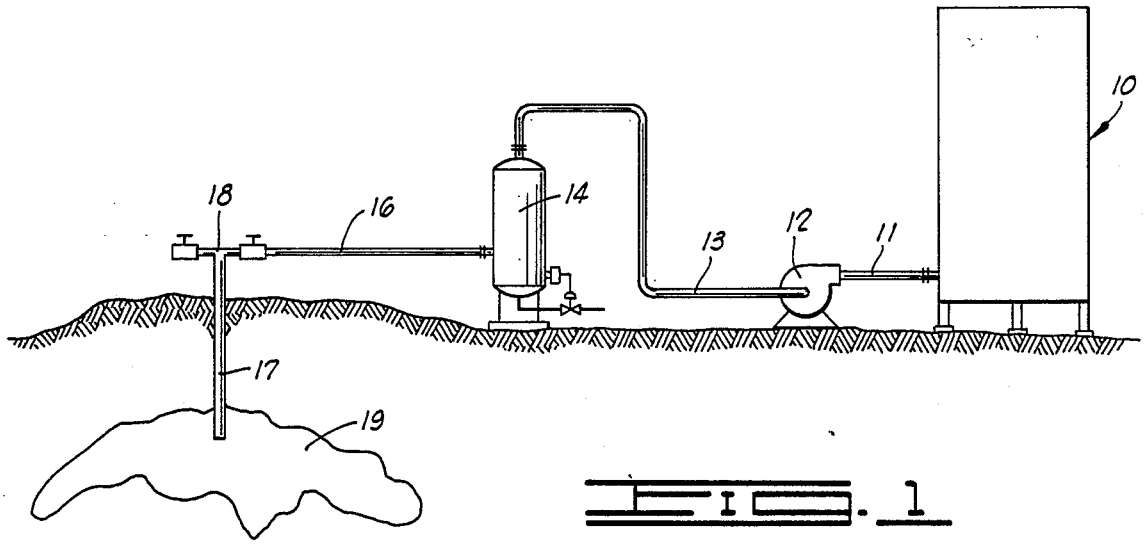
FIG. 1 is a schematic illustration of apparatus of the present invention connected to a landfill.

Referring now to the drawings and particularly to FIG. 1, the gas flaring apparatus of the present invention, generally designated by the numeral 10, is schematically illustrated connected to a source of landfill gas. That is, the flare apparatus 10, which will described in detail herebelow, is connected by a conduit 11 to the gas outlet of a conventional gas blower 12. The inlet of the blower 12 is connected to the gas outlet of a conventional gas-liquid separator 14 by a conduit 13. The inlet connection of the separator 14 is connected by a conduit 16 to a manifold 18 which is in turn communicated with the landfill 19 by a conduit 17.

In operation, a stream of gas from the landfill 19 is withdrawn therefrom and caused to flow by the blower 12 through the conduit 17, the manifold 18 and the conduit 16 to the separator 14. The gas stream includes flammable gases produced by degradation in the landfill, and possibly air drawn into the landfill by the blower suction, and may therefore be combustible. While flowing through the separator 14, condensed liquids carried with the gas stream are separated from the gas stream and removed. The resulting liquid-free gas stream flows by way of the conduit 13, the blower 12 and the conduit 11 to the flare apparatus 10.

The stream of gas flowing to the flare apparatus 10 is combusted therein and the products of combustion formed are discharged to the atmosphere. In addition, the apparatus 10 retards the backward propagation of flame through the stream of gas even though such gas stream is at low pressure and low or static flow rate conditions.

Figure 2:
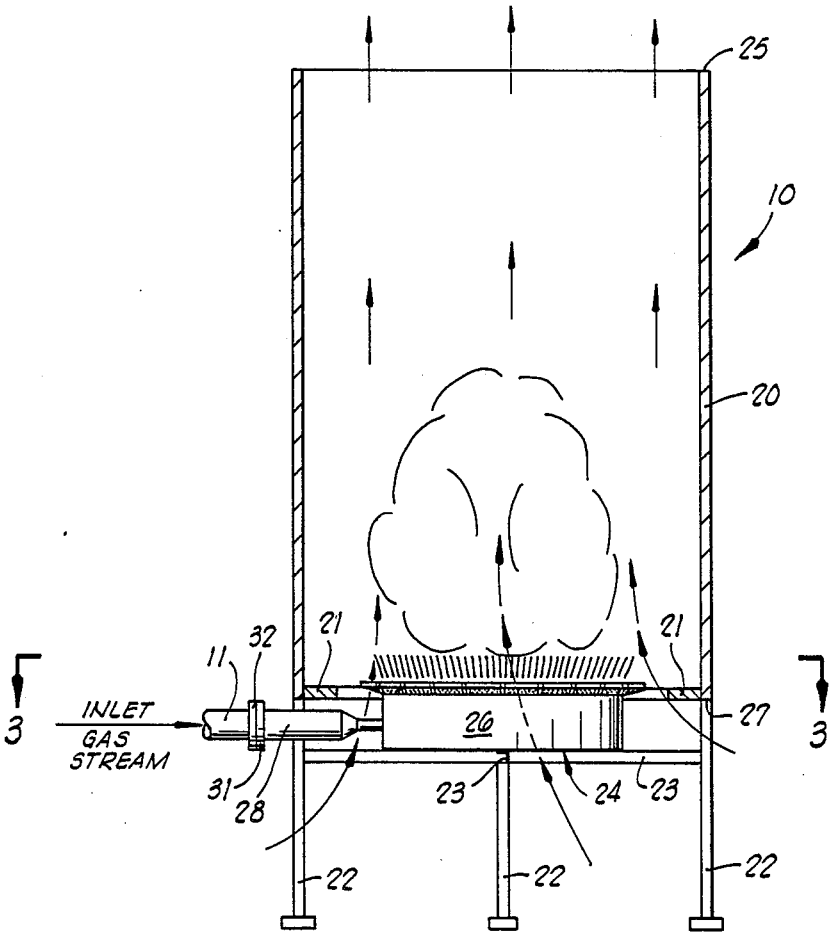
FIG. 2 is a vertical cross-sectional view of the flare apparatus of the present invention.
Figure 3:
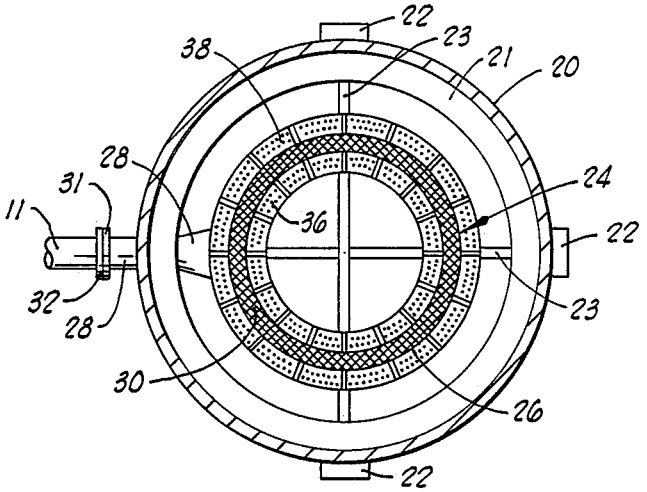
FIG. 3 is a cross-sectional view taken along line 3—3 of FIG. 2.

Referring now to FIGS. 2–5, a preferred form of the flare apparatus 10 is illustrated in detail. As best shown in FIG. 2, the apparatus 10 is comprised of a vertically positioned preferably cylindrical stack 20 which is open at both its upper end 25 and lower end 27. The lower end 27 of the stack 20 is held above ground level by a plurality of legs 22 attached thereto and a burner, generally designated by the numeral 24, is disposed within the stack 20 adjacent the lower end 27 thereof. The burner 24 is supported concentrically with respect to the stack 20 by cross members 23 attached thereto and to the legs 22.

An annular air flow restricting ring 21 can optionally be attached within the stack 20 at its lower end 27. The ring 21 is of an internal diameter such that the cross-sectional area available for air flow into the stack 20 is optimized for the particular design combustion conditions therein. In addition to or in lieu of the ring 21, a skirt (not shown) with sized openings therein or with manually or automatically adjustable louvers attached thereto can be utilized between the bottom end 27 of the stack 20 and ground level. The control of the rate of air flow into the stack 20 insures the efficient combustion of the gas mixture being flared by the apparatus 10.

The burner 24 is comprised of an annular channel 26 having vertical sides and a horizontal bottom, and having a continuous annular labyrinth structure 30 disposed within and closing the upper portion thereof. The lower chamber 29 formed below the labyrinth 30 within the channel 26 is connected to an inlet conduit 28. The inlet conduit 28 extends beneath the lower end 27 of the stack 20 and terminates in a flange fitting 31 which is connected to a complementary flange fitting 32 attached to the conduit 11.

The labyrinth 30 contains a plurality of upwardly extending elongated flow passages 33 (FIG. 4), each of which has its length related to its cross-sectional area in a known manner to allow a required rate of gas to pass therethrough and to be jetted therefrom, but which prevents or retards reverse propagation of flame through the gas. That is, the labyrinth 30 retards reverse flame propagation therethrough by quenching the flame after it enters the passages 33. The reverse flame propagation arresting labyrinth 30 can be formed in a variety of ways from various materials. For example, the labyrinth 30 can be constructed by spirally winding a corrugated sheet and a flat sheet whereby adjacent layers of the flat and corrugated sheet form the elongated flow passages 33 therein.

Figure 4:
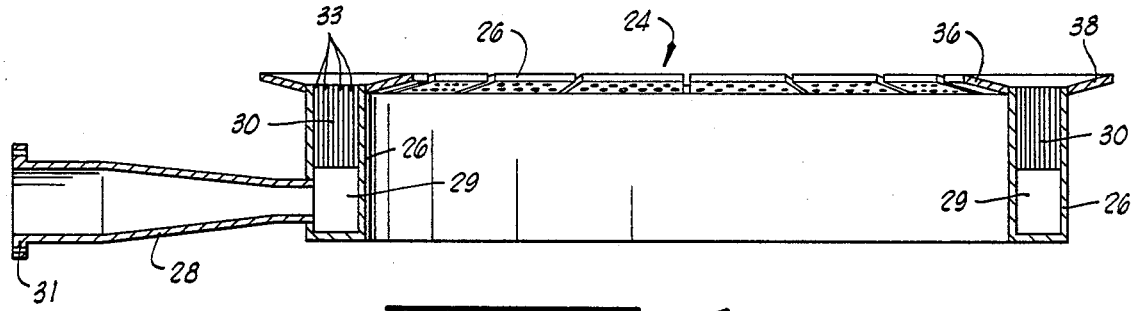
FIG. 4 is an enlarged side cross-sectional view of the burner of FIGS. 2 and 3.
Figure 5:
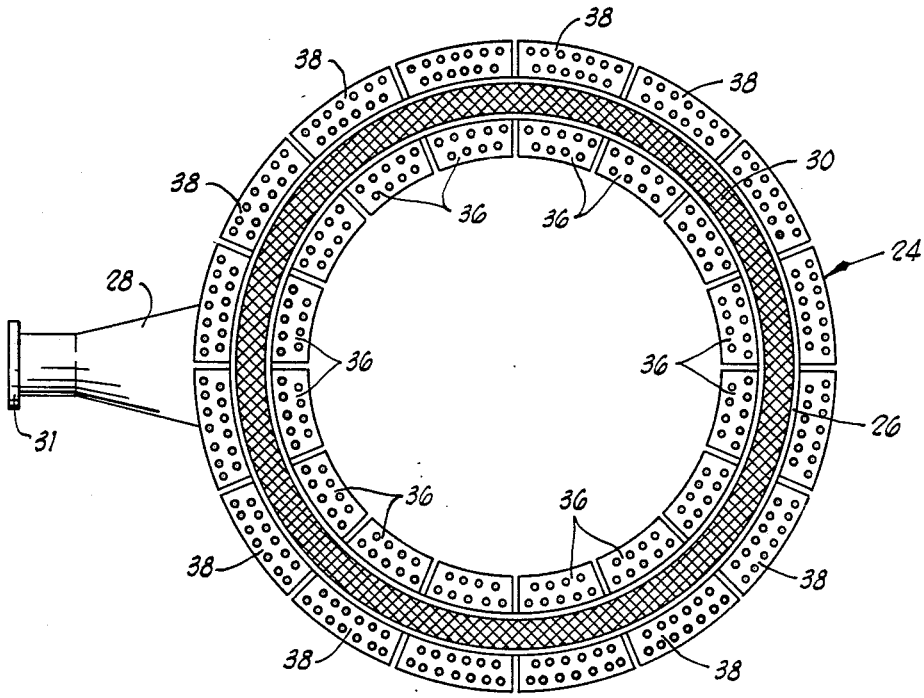
FIG. 5 is a top view of the burner of FIG. 4.

As best shown in FIGS. 4 and 5, inwardly and outwardly extending baffles 36 and 38, respectively, are attached to both sides of the channel 26 of the burner 24 at the top thereof. The baffles 36 and 38 completely encircle the top of the channel 26 and the labyrinth structure 30 therein on both sides thereof and each of the baffles contains a plurality of openings therein for the passage of air therethrough. The baffles 36 and 38 may be inclined upwardly at small angles from the horizontal and function to retain flame adjacent the burner 24 by interrupting and reducing the velocity of the upward air flow. As illustrated by the arrows on FIG. 2, air is drawn into the stack 20 by way of the annular opening between the ring 21 of the stack 20 and the burner 24 as well as by way of the central opening in the burner 20. In order to insure that air drawn into the stack 20 around the burner 24 contributes to the efficient combustion of the gases being flared, the internal central opening of the burner 24, i.e., the opening defined by the internal sides of the channel 26, is of an area of at least about 10% of the total cross-sectional area available for atmospheric air flow into the stack 20.

In operation of the flare apparatus 10, a stream of gas flows by way of the conduit 28 into the lower chamber 29 of the annular burner 24. From the chamber 29, the gas stream flows through the labyrinth structure 30 by way of the upwardly extending passages 33 thereof and is jetted into the stack 20. As the gas stream is jetted from the burner 24, it mixes with air surrounding the burner and is ignited by conventional igniting apparatus (not shown) or by previously ignited gases within the stack 20.

The burning of the initially formed gas-air mixture and the upward flow thereof draws air from the atmosphere into the lower end 27 of the stack 20 which flows upwardly around and through the flame retaining baffles 36 and 38 and the burner 24 whereby additional air mixes with the gas stream and brings about the efficient combustion thereof. As mentioned above, the air flows upwardly through the interior opening in the burner 24 as well as through the annular area between the burner 24 and the ring 21 of the stack 20 whereby it mixes with the gases exiting the passages 33 and combustion takes place. The resulting combustion products flow into the atmosphere by way of the open upper end 25 of the stack 20 thereby completing the flaring process.

As mentioned above, the flow passages of the burner 24 are configured such that the gas to be flared can be flowed therethrough and jetted therefrom, but the backward propagation of flame through the gas into the interior of the burner, conduits and other components is retarded. By confining the jetted and ignited gas stream within the stack 20 and providing air flow thereinto whereby air is mixed with the upwardly flowing combusting gases, efficient combustion takes place.

Figure 6:
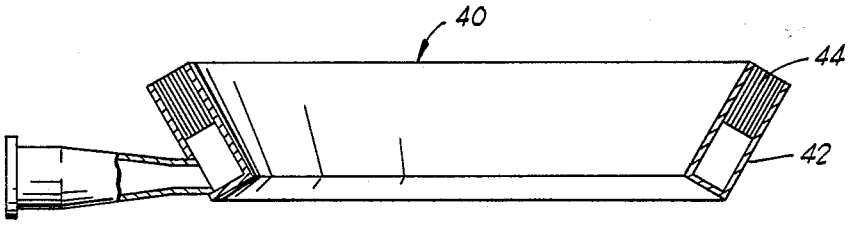
FIG. 6 is a side cross-sectional view of an alternate form of burner.
Figure 7:
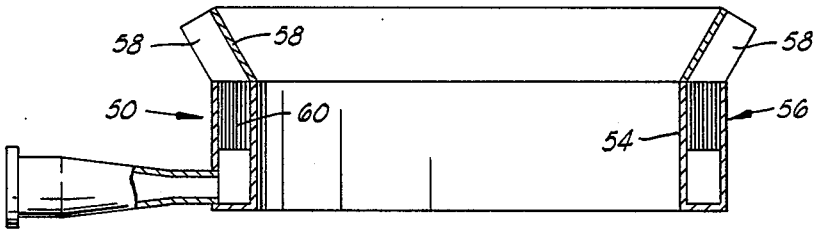
FIG. 7 is a side cross-sectional view of another form of burner.
Figure 8:
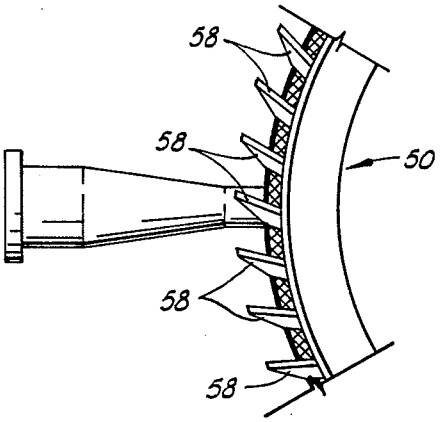
FIG. 8 is a partial top view of the burner of FIG. 7.

Referring now to FIGS. 6–8, alternate forms of burners which can be substituted for the burner 24 in the apparatus 10 are illustrated. In FIG. 6, a burner 40 is illustrated which is identical to the burner 24 described above except that it does not include the flame retention baffles 36 and 38 and it directs a gas mixture emitted therefrom outwardly as well as upwardly. That is, the burner 40 is formed of an annular channel 42, the sides of which are inclined outwardly. An annular labyrinth structure 44 closes the top of the channel 42.

FIGS. 7 and 8 illustrate a burner 50 which is similar to the burner 24 described above except that in addition to or instead of the flame retention baffles 36 nd 38, the burner 50 includes a baffle arrangement attached thereto which causes a gas mixture emitted therefrom to be directed upwardly and outwardly in a spiral path. That is, the burner 50 includes a continuous, inverted truncated cone-shaped baffle 52 attached to the top of the interior side 54 of the channel 56 forming the burner. A plurality of outwardly extending spaced apart baffles 58 are attached to the baffle 52 and the baffles 58 are positioned so that gases jetted upwardly from the labyrinth structure 60 of the burner 50 are deflected outwardly by the baffle 52 and then into a spiral path by the baffles 58.

The burners 40 and 50 are utilized in the flare apparatus 10 in lieu of the burner 24 when it is necessary to achieve a higher degree of turbulence and gas-air mixing within the stack 20 in order to achieve efficient combustion. As will be understood, various alternate burner, gas directing baffle and flame retention baffle arrangements can be utilized to achieve desired combustion efficiency results including burners which jet the gas stream to be flared inwardly.

The method and apparatus of the present invention bring about the efficient flaring of gas mixtures such as those withdrawn from landfills and retard the possibility of explosions or fires taking place due to reverse flame propagation. Thus, the present invention is well adapted to carry out the objects and advantages mentioned as well as those inherent therein. While numerous changes in the arrangement of steps and elements can be made by those skilled in the art, such changes are encompassed within the spirit of this invention as defined by the appended claims.

What is claimed is:

1. A method of flaring a gas mixture formed in a landfill comprising the steps of:

withdrawing said gas mixture from said landfill;

conducting said gas mixture to an annular burner comprised of an annular channel having sides and a bottom and a continuous top structure having a plurality of elongated flow passages therein configured such that said gas mixture can flow through said passages but the backward propagation of flame therethrough at low pressure and low or static flow rate conditions is retarded;

flowing said gas mixture through said passages in said burner structure whereby the gas mixture is jetted therefrom and caused to mix with air surrounding said burner;

igniting the resulting gas mixture; and confining said ignited gas mixture within a vertical stack configured to allow the admission of additional air around said burner structure and to discharge combustion products into the atmosphere above said stack.

2. The method of claim 1 which is further characterized to include the step of separating condensed liquids from said gas mixture prior to flowing said gas mixture through said passages in said burner structure.

3. The method of claim 1 wherein said annular burner includes an interior opening therein for the admission of air therethrough, said opening having a cross-sectional area equal to at least 10% of the cross-sectional area available for the admission of air into said stack.

4. Apparatus for flaring a gas stream formed in a landfill while retarding the backward propagation of flame through the apparatus comprising:

a stack having an opening in a lower portion thereof for admitting air therewithin and an opening in an upper portion thereof for discharging products of combustion into the atmosphere;

a burner comprised of an annular channel having sides and a bottom and a continuous top structure having a plurality of elongated flow passages therein configured such that said gas stream can flow through said passages but the backward propagation of flame therethrough at low pressure and low or static flow rate conditions is retarded, said burner having an opening therein positioned interiorly of said flow passages for the flow of air therethrough, and said burner being positioned at least partially within the interior of said stack at said lower portion thereof; and conduit means connected to said burner for conducting said gas stream to said burner whereby said gas stream is jetted from said burner by way of said flow passages.

5. The apparatus of claim 4 wherein said burner is annular and said gas stream is jetted from upwardly facing flow passages in a circular pattern.

6. The apparatus of claim 4 wherein said stack is cylindrical.

7. The apparatus of claim 4 wherein the area of the interior opening in said burner is at least 10% of the cross-sectional area of said opening in said stack for admitting air therewithin.

* * * * *